US008757925B2

(12) United States Patent
Banchio

(10) Patent No.: US 8,757,925 B2
(45) Date of Patent: Jun. 24, 2014

(54) CORDLESS CONCRETE FINISHING TOOL

(75) Inventor: Todd Micheal Banchio, Taylorsville, CA (US)

(73) Assignee: Todd Michael Banchio, Taylorsville, CA (US)

( * ) Notice: Subject to any disclaimer, the term of this patent is extended or adjusted under 35 U.S.C. 154(b) by 474 days.

(21) Appl. No.: 13/177,455

(22) Filed: Jul. 6, 2011

(65) Prior Publication Data

US 2012/0071066 A1 Mar. 22, 2012

Related U.S. Application Data

(60) Provisional application No. 61/383,656, filed on Sep. 16, 2010.

(51) Int. Cl.
*E01C 19/22* (2006.01)

(52) U.S. Cl.
USPC ..... 404/112; 15/52; 15/79.2; 451/353; 451/359; 451/524

(58) Field of Classification Search
CPC ..... B24B 23/02; B24B 23/022; E01C 19/22
USPC ..... 15/50.2, 52, 52.2, 79.1, 79.2, 87, 98; 125/1, 36, 38; 404/92, 112; 451/350, 451/351, 353, 359, 524, 525
See application file for complete search history.

(56) References Cited

U.S. PATENT DOCUMENTS

| | | | | |
|---|---|---|---|---|
| 2,860,506 | A * | 11/1958 | Drummond | 404/112 |
| 3,698,293 | A | 10/1972 | Wagner | |
| 4,027,991 | A | 6/1977 | Maass | |
| 4,198,178 | A | 4/1980 | Carlstrom et al. | |
| 4,702,641 | A | 10/1987 | Naser et al. | |
| 4,740,348 | A | 4/1988 | Rose | |
| 4,848,960 | A | 7/1989 | Kajioka et al. | |
| 5,102,258 | A * | 4/1992 | Berger | 404/97 |
| 5,372,452 | A | 12/1994 | Hodgson | |
| 5,405,216 | A | 4/1995 | Allen et al. | |
| 5,540,519 | A | 7/1996 | Weber | |
| 5,829,874 | A | 11/1998 | Breeding | |
| 5,837,298 | A | 11/1998 | Face, Jr. et al. | |
| 6,019,545 | A | 2/2000 | Allen et al. | |
| 6,139,217 | A | 10/2000 | Reuter | |
| 6,485,360 | B1 * | 11/2002 | Hutchins | 451/357 |
| 7,097,384 | B2 | 8/2006 | Lindley | |
| 7,144,194 | B2 * | 12/2006 | Kipp, Jr. | 404/112 |
| 7,674,069 | B2 | 3/2010 | Stenzel | |
| 2003/0215289 | A1 * | 11/2003 | Williams | 404/112 |
| 2004/0003503 | A1 | 1/2004 | McDonald | |
| 2004/0076470 | A1 | 4/2004 | Goossens | |
| 2004/0165952 | A1 | 8/2004 | Glenn et al. | |
| 2006/0083589 | A1 * | 4/2006 | McClain | 404/112 |
| 2008/0025794 | A1 * | 1/2008 | Barcenas | 404/112 |
| 2008/0029134 | A1 * | 2/2008 | Long et al. | 134/115 R |
| 2008/0253221 | A1 | 10/2008 | Lindley | |
| 2009/0274517 | A1 | 11/2009 | Rose | |
| 2009/0297269 | A1 | 12/2009 | Tijerina, Jr. | |
| 2012/0216841 | A1 * | 8/2012 | Rosenzweig et al. | 134/106 |

* cited by examiner

*Primary Examiner* — Timothy V Eley
(74) *Attorney, Agent, or Firm* — Todd Michael Banchio

(57) ABSTRACT

A concrete finishing tool includes a body having a chassis, a guard, and frame supports. An extension handle is attached to the body, and a motor is attached to the body and operatively connected to a driving gear and driven gear to rotate blades having a quick change coupling mechanism. An integrated handle is configured on the body and houses a switch for the motor that is powered by a power supply.

10 Claims, 3 Drawing Sheets

CORDLESS CONCRETE FINISHING TOOL

CROSS REFERENCE TO RELATED APPLICATIONS

The present application claims priority to U.S. Provisional Patent application No. 61/383,656, filed Sep. 16, 2010, the entire content of which is incorporated herein by reference.

BACKGROUND OF THE INVENTION

The present invention generally relates to manually operated finishing tools, and, more particularly, to concrete finishing tools having a trowel or a surface finishing attachment in combination with a cordless power tool and a light.

Freshly poured concrete begins to cure immediately, and may be formed, smoothed, and finished to achieve its final form using hand-held, manually operated tools that may include a trowel and a brush that may be attached to a long boom handle for finishing larger surface areas. Some finishing tools are not suitable for use on smaller surface areas and surfaces having hard to reach areas. Some finishing tools require significant manual effort to achieve a smooth or finished surface and thus result in considerable fatigue when working with larger surface areas and heavier concrete. Some finishing tools are bulky and are cumbersome when maneuvering around difficult to reach places. Some finishing tools only allow linear patterns or finishes to be applied to a concrete surface.

As can be seen, there is a need for an improved apparatus for finishing freshly poured concrete surfaces that reduces fatigue on a user, provides an ability to maneuver into hard to reach areas, and provides an ability to apply non-linear, circular or wave-like finishes to the concrete surface.

SUMMARY OF THE INVENTION

In one aspect of the present invention, a cordless concrete finishing tool comprises a body having a chassis, a guard, and frame supports; an extension handle attached to the body; a motor assembled to the body and operatively connected to a driving gear; a driven gear interconnected to the driving gear, and disposed to rotate blades that are connected to the driven gear by a quick-change coupling mechanism; an integral handle configured on the body and disposed to house a switch for the motor; and a power supply disposed to provide power for the motor.

In another aspect of the present invention, a cordless concrete finishing tool comprises a body including an injection molded polymer formed as a chassis, wherein the chassis has an integrated handle' and frame supports that support a guard; a threaded socket formed in, the body and disposed on an outside surface thereof; a rotating blade assembly housed by the guard; a motor operably connected to the rotating blade assembly by a driving gear and a driven gear; a variable speed switch operable to activate the motor; a light disposed on an outside of the body and operable to illuminate a working surface of the concrete finishing tool; and a removable power supply configured to power the motor.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, embodiments of the present invention generally provide a cordless concrete finishing tool that uses cordless motor technology to reduce the labor of the troweling process by reducing both a fatigue of a laborer and a time needed to trowel or finish a freshly poured surface. The finishing tool may be more practical for typical size jobs that may be more common than larger size jobs. The finishing tool may be portable and sized to make finishing hard to reach places possible and easy.

Figure 1:
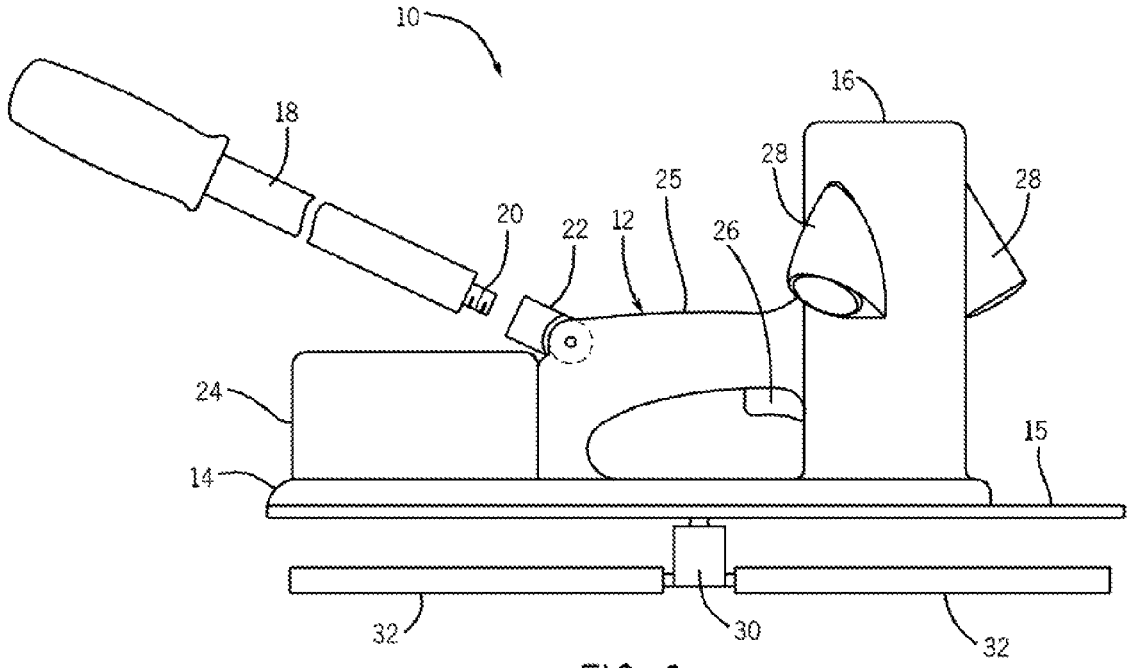
FIG. 1 shows a side perspective view of a tool according to an embodiment of the present invention.
Figure 2:
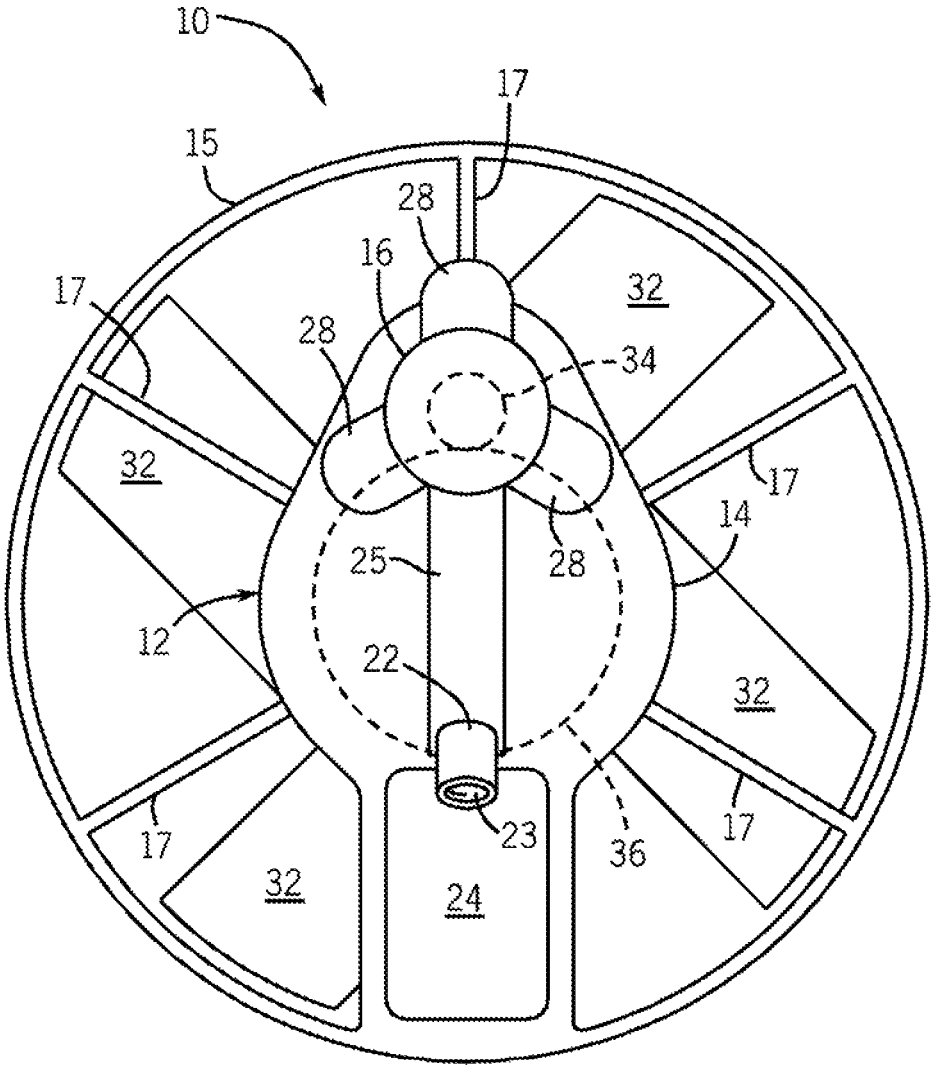
FIG. 2 shows a top plan view of the tool shown in FIG. 1.
Figure 3:
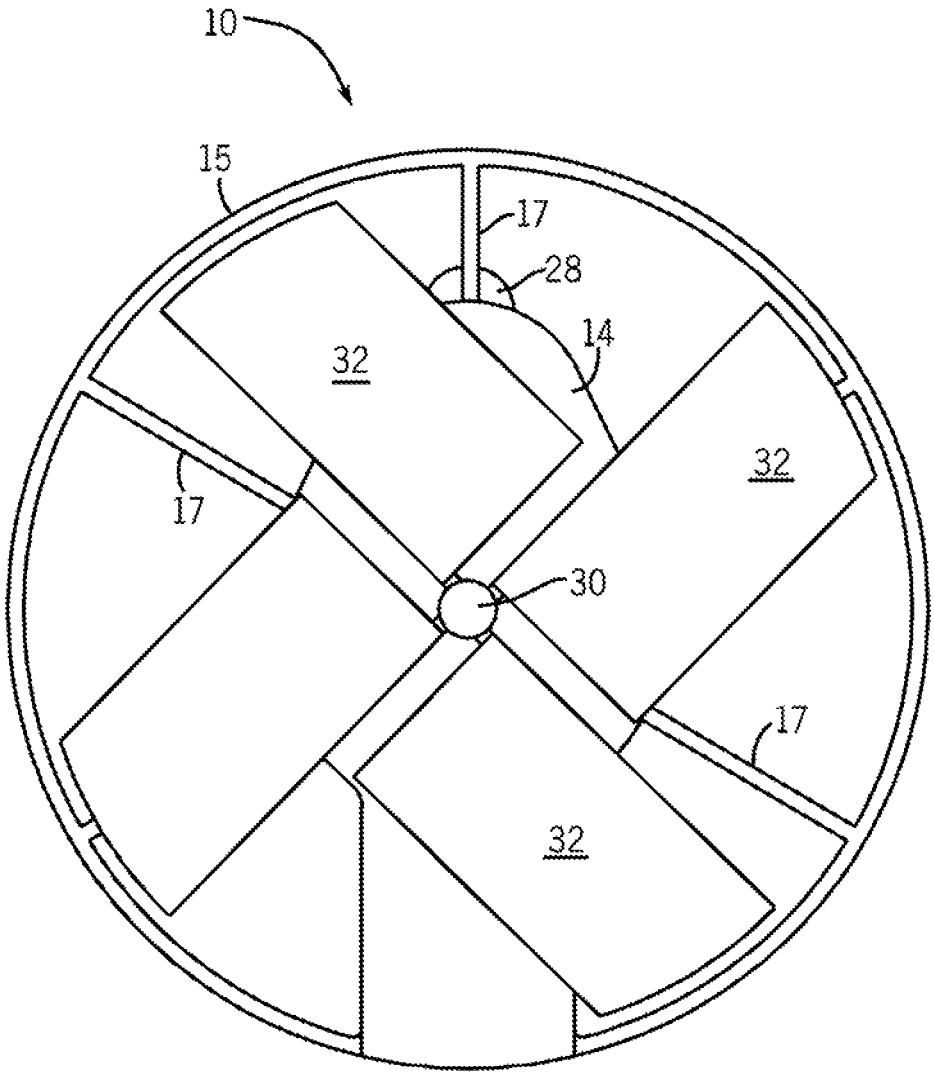
FIG. 3 shows a bottom plan view of the tool shown in FIG. 1.

Referring to FIGS. 1-3, side perspective, top plan, and bottom plan views of an exemplary embodiment of the present invention are shown respectively. A cordless concrete finishing tool 10 may have a body 12, a chassis 14, and a guard 15 held or supported by frame supports 17. A motor 16, which may run on a battery 24, may be provided for the tool 10, along with an extension handle 18 that may have a threaded stud 20 that assembles to a socket 22 that may have a threaded hole 23. The tool 10 may also include an integral handle 25, which may house a variable speed switch 26. One or more lights 28 may be provided for the tool 10. A quick-change coupling 30 may be provided for blades 32, along with a driving gear 34 and a driven gear 36 for rotating the blades 32, which may include a plurality of blades on a carrier, to form a rotating blade assembly.

The body 12, chassis 14, and guard 15 may be made from an injection molded polymer or stamped metal, and may be capable of providing a rigid body construction. According to an exemplary embodiment, an overall size of the tool 10 may be about 5 inches wide, about 4 inches tall, and about 12 inches long. The tool 10 may include a handle 25 for gripping, and may include an extension handle 18, which may be a pole or boom, for using the tool 10 in areas that may be out of arms reach. The handle 25 and extension handle 18 may be placed on the tool 10 at any suitable position, location, or angle. The blades 32 may comprise a set of four trowel blades, for example, and may be stainless steel or any other suitable rigid material. The tool 10 may include a cordless motor 16, which may be a battery powered motor connected to one or more high voltage (e.g., 36 volt) batteries 24 (e.g., part of a removable power pack) that may have a battery transfer switch for when the battery 24 becomes drained, along with a low battery warning indicator. The tool 10 may be water proof, and may have one or more lights 28, which may be disposed on the body 12 or the chassis 14, and which may be activated by the variable speed switch 26. The tool 10 may include a guard 15 for safety, which may contain and follow a contour of the rotating blade assembly, and may be configured in various shapes or sizes to prevent debris from being thrown by the rotating blade assembly and prevent from items from interfering therewith. A quick change coupling 30 may secure the blades 32 and may provide a tool-free replacement for possible optional attachments (e.g., float trowels or finish trowels).

The blades 32 may comprise a suitable blade configuration for troweling and may include a suitable connection means to attach the trowels to the motor 16. The guard 15 may enclose the blades 32, and may attach to the body 12 of the tool 10. One or more gears may be provided on the inside of the body 12, which may be configured to transfer power from the motor 16 to the driven gear 36, which in turn may spin the trowels. An on/off switch may be provided which can allow power to get to the motor and drive the gears. The trowels may be configured to spin in either direction for smoothing the concrete.

To make an embodiment of the present invention, the body 12 may be molded or stamped and the motor 16 may be mounted thereto. The gears 34, 36 may be mounted to the body 12 and interconnected to the motor, which may be connected to all electrical connections and switch 26. The trowels may be manufactured and welded.

In an alternative embodiment, the trowel heads may be changed from a float trowel to a finish trowel. The battery may be located in various locations, and the location of the lights may vary. The drive gears 34, 36 may vary in configuration to suit a particular purpose. The drive gears 34, 36 may be interconnected by a belt (e.g., toothed, V-belt, or flat belt) or chain. The body 12 may be configured in different styles having different types of guards 15 in various colors.

To use an embodiment of the tool 10, a user may install a battery or batteries into the tool 10, select the type of trowel needed for the job, and assemble the trowel on the quick change coupling 30. The user may then place the tool on a slab of concrete and activate the switch 26, which may allow the rotating motion of the trowels of the blades 32 to finish the concrete.

It should be understood, of course, that the foregoing relates to exemplary embodiments of the invention and that modifications may be made without departing from the spirit and scope of the invention as set forth in the following claims.

What is claimed is:

1. A cordless concrete finishing tool, comprising:

a body having a chassis, a guard, and frame supports;

a motor assembled to the body and operatively connected to a driving gear;

a driven gear interconnected to the driving gear, and disposed to rotate blades that are connected to the driven gear by a quick-change coupling mechanism;

an integral handle configured on the body and housing a switch for the motor, the motor being located on the chassis at one end of the integral handle;

at least one removable power supply disposed on the chassis outside of the integral handle and proximate thereto to provide power for the motor; and an extension handle attached to the integral handle at another end of the integral handle opposite the motor.

2. The concrete finishing tool of claim 1, wherein the frame supports are disposed between the chassis and the guard.

3. The concrete finishing tool of claim 1, wherein the extension handle is attached to the body by a threaded stud located on an end of the extension handle that assembles to a socket disposed on the body.

4. The concrete finishing tool of claim 3, further comprising a light, wherein the light is disposed on the chassis.

5. The concrete finishing tool of claim 4, wherein the light is activated when the switch is activated.

6. The concrete finishing tool of claim 1, wherein the switch is a variable speed switch.

7. The concrete finishing tool of claim 1, wherein the power supply is a removable power pack having a rechargeable battery.

8. A cordless concrete finishing tool, comprising:

a body including an injection molded polymer formed as a chassis, wherein the chassis has an integrated handle and frame supports that support a guard;

a threaded socket formed on the body and disposed on an outside surface thereof;

a rotating blade assembly housed by the guard;

a motor operably connected to the rotating blade assembly by a driving gear and a driven gear, wherein the rotating blade assembly is connected to the driven gear, the motor being located on the chassis at one end of the integrated handle;

a variable speed switch operable to activate the motor;

a light disposed on an outside of the body and operable to illuminate a working surface of the concrete finishing tool;

at least one removable power supply configured to power the motor, the power supply disposed on the chassis outside of the integrated handle and proximate thereto; and an extension handle attached to the integrated handle at another end of the integrated handle opposite the motor.

9. The concrete finishing tool of claim 8, further comprising a quick change coupling to secure the rotating blade assembly to the driven gear.

10. The concrete finishing tool of claim 9, wherein the rotating blade assembly includes a concrete surface finishing tool chosen from a group consisting of a float trowel, a finish trowel, and a texturizing brush.

* * * * *